US012281861B2

(12) United States Patent
Allahar et al.

(10) Patent No.: US 12,281,861 B2
(45) Date of Patent: Apr. 22, 2025

(54) METHODS OF ANODIZING THE INTERNAL SURFACE OF HEAT TRANSFER TUBES

(71) Applicant: Carrier Corporation, Palm Beach Gardens, FL (US)

(72) Inventors: Kerry Allahar, Syracuse, NY (US); Jefferi J. Covington, Baldwinsville, NY (US); Matthew Patterson, East Syracuse, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 656 days.

(21) Appl. No.: 17/445,917

(22) Filed: Aug. 25, 2021

(65) Prior Publication Data

US 2022/0065563 A1 Mar. 3, 2022

Related U.S. Application Data

(60) Provisional application No. 62/706,594, filed on Aug. 27, 2020.

(51) Int. Cl.
*F28F 13/00* (2006.01)
*F28F 13/18* (2006.01)
(Continued)

(52) U.S. Cl.
CPC ..... *F28F 13/18* (2013.01); *F28F 19/06* (2013.01); *F28F 21/084* (2013.01)

(58) Field of Classification Search
CPC .... C25D 11/02; C25D 11/022; C25D 17/008; C25B 11/00
See application file for complete search history.

(56) References Cited

U.S. PATENT DOCUMENTS 3,471,375 A * 10/1969 Cooke ..... C25D 11/08 205/147
5,035,282 A 7/1991 Kawashita et al.
(Continued)

FOREIGN PATENT DOCUMENTS

AU 2002344574 7/2003
CN 106662415 11/2018
(Continued)

OTHER PUBLICATIONS

Extended European Search Report received for EP Application No. 21191772, mailed on Jan. 21, 2022, 5 Pages.

*Primary Examiner* — Zulmariam Mendez
(74) *Attorney, Agent, or Firm* — Drew Folgmann

(57) ABSTRACT

Disclosed is a method of anodizing the interior surface of a heat transfer tube comprising placing a plurality of contact electrodes in electrical communication with, and along, an exterior surface of the heat transfer tube, inserting a counter electrode into an interior space of the heat transfer tube, providing an electrolytic solution to the interior space of the heat transfer tube, passing an electric current between the plurality of contact electrodes and the counter electrode through the electrolytic solution, forming an oxidation layer along the interior surface of the heat transfer tube, wherein the oxidation layer has an oxidation layer thickness that decreases along a length of the heat transfer tube, stopping the passage of the electric current, removing the electrolytic solution, and applying a sealing solution to a surface of the oxidation layer to form a sealed oxidation layer along the interior surface of the heat transfer tube.

5 Claims, 5 Drawing Sheets

(51) Int. Cl.
*F28F 19/06* (2006.01)
*F28F 21/08* (2006.01)

(56) References Cited

U.S. PATENT DOCUMENTS

| | | | | |
|---|---|---|---|---|
| 6,368,483 | B1 | 4/2002 | Ball et al. | |
| 9,458,547 | B2 | 10/2016 | Shen et al. | |
| 9,790,612 | B2 | 10/2017 | Amakusa et al. | |
| 2003/0098145 | A1 | 5/2003 | Tada et al. | |
| 2008/0296150 | A1* | 12/2008 | Haglund | C25D 5/06 204/194 |
| 2015/0068910 | A1* | 3/2015 | Kim | C25D 11/022 204/241 |

FOREIGN PATENT DOCUMENTS

| | | | |
|---|---|---|---|
| DE | 102012109812 | A1 | 4/2014 |
| FR | 2240305 | A1 | 3/1975 |
| FR | 3077303 | | 8/2019 |
| JP | S5839796 | A | 3/1983 |
| JP | 2002371381 | | 12/2002 |
| JP | 03402234 | | 5/2003 |
| JP | 2005097703 | | 4/2005 |
| JP | 04336534 | | 9/2009 |
| JP | 2012162769 | | 8/2012 |
| JP | 05534951 | | 7/2014 |
| KR | 706972 | | 4/2007 |
| WO | 2007019362 | | 2/2007 |
| WO | 2008142700 | | 11/2008 |
| WO | 2009017039 | | 2/2009 |
| WO | 2017074877 | | 5/2017 |

* cited by examiner

METHODS OF ANODIZING THE INTERNAL SURFACE OF HEAT TRANSFER TUBES

CROSS REFERENCE TO A RELATED APPLICATION

The application claims the benefit of U.S. Provisional Application No. 62/706,594 filed Aug. 27, 2020, the contents of which are hereby incorporated in their entirety.

BACKGROUND

Exemplary embodiments pertain to the art of anodizing aluminum parts. More particularly, the present disclosure relates to anodizing aluminum heat exchanger part and methods for manufacturing the same.

Aluminum offers a lighter, less expensive alternative to copper for the manufacture of heat exchangers. However, aluminum can be more susceptible to corrosion and fouling. For example, water cooled chillers can be exposed to a wide variety of water qualities that can cause corrosion and fouling of the water-bearing heat transfer tubes. Given the unique geometry, size, and weight of these tubes, it can be very difficult to efficiently and effectively apply a surface treatment to them. As manufacturers seek to utilize aluminum or other non-traditional metals (e.g. other than copper) for the manufacture of heat exchanger tubes, there remains a need in the art for new surface treatments and cost-effective methods of their application.

BRIEF DESCRIPTION

Disclosed is a method of anodizing the interior surface of a heat transfer tube comprising: placing a plurality of contact electrodes in electrical communication with, and along, an exterior surface of the heat transfer tube, inserting a counter electrode into an interior space of the heat transfer tube, providing an electrolytic solution to the interior space of the heat transfer tube, passing an electric current between the plurality of contact electrodes and the counter electrode through the electrolytic solution, forming an oxidation layer along the interior surface of the heat transfer tube, wherein the oxidation layer has an oxidation layer thickness that decreases along a length of the heat transfer tube, stopping the passage of the electric current, removing the electrolytic solution, and applying a sealing solution to a surface of the oxidation layer to form a sealed oxidation layer along the interior surface of the heat transfer tube.

In addition to one or more of the above disclosed aspects or as an alternate further comprising configuring the counter electrode to have a decreasing electrical conductivity along its length, and wherein the decrease in the oxidation layer thickness along the length of the heat transfer tube corresponds to a decrease in electrical conductivity along the length of the counter electrode.

In addition to one or more of the above disclosed aspects or as an alternate wherein the configuring the counter electrode to have a decreasing electrical current flux along its length further comprises configuring the counter electrode to have a decreasing thickness of electrical shielding along at least a portion of its length.

In addition to one or more of the above disclosed aspects or as an alternate wherein the configuring the counter electrode to have a decreasing electrical conductivity along its length further comprises configuring the counter electrode to have one or more sections of electrical shielding disposed along its length, and wherein the one or more sections are arranged to having a decreasing electrical conductivity along the length of the counter electrode.

In addition to one or more of the above disclosed aspects or as an alternate wherein the inserting the counter electrode further comprises inserting the counter electrode to an insertion depth that extends partially into an interior space of the heat transfer tube, and wherein at least a portion of the decrease in the oxidation layer thickness along the length of the heat transfer tube corresponds to the insertion depth.

In addition to one or more of the above disclosed aspects or as an alternate wherein the forming the oxidation layer further comprises adjusting a flow of the electric current between the plurality of contact electrodes and the counter electrode to change the oxidation layer thickness along at least a portion of the length of the heat transfer tube.

In addition to one or more of the above disclosed aspects or as an alternate wherein the passing the electric current further comprises applying electrical energy to the contact electrodes and counter electrode thereby creating a voltage difference therebetween.

In addition to one or more of the above disclosed aspects or as an alternate further comprises positioning the plurality of contact electrodes along the length of the heat transfer tube.

Further disclosed is a chiller comprising a plurality of heat exchangers, wherein at least one of the plurality of heat exchangers comprises a plurality of heat transfer tubes, wherein an oxidation layer formed on the interior surface of one or more tubes of the plurality of heat transfer tubes, and wherein the oxidation layer has an oxidation layer thickness that decreases along a length of the heat transfer tube.

In addition to one or more of the above disclosed aspects or as an alternate wherein the heat transfer tube substantially comprises aluminum.

Further disclosed is a heat transfer tube anodizing apparatus comprising a plurality of contact electrodes configured for placement in electrical communication with, and along, the external surface a heat transfer tube, a counter electrode comprising a decreasing thickness of electrical shielding along at least a portion of its length, a power supply comprising a positive terminal and a negative terminal, wherein the plurality of contact electrodes are disposed in electrical communication with the positive terminal and the counter electrode is disposed in electrical communication with the negative terminal, and a controller configured to adjust an electrical parameter of the power supply, wherein the electrical parameter comprises an output power, and output voltage, an output current, or a combination comprising at least one of the foregoing.

In addition to one or more of the above disclosed aspects or as an alternate wherein the counter electrode comprises a metal wire having electrical shielding extending along at least a portion its length.

In addition to one or more of the above disclosed aspects or as an alternate wherein the counter electrode comprises a plurality of metal wires having electrical shielding extending along at least a portion their lengths.

In addition to one or more of the above disclosed aspects or as an alternate wherein the electrical shielding comprises a plurality of electrical shielding sections disposed along the length of the counter electrode, and wherein at least two sections have different electrical conductivity values.

In addition to one or more of the above disclosed aspects or as an alternate wherein the plurality of electrical shielding sections are arranged to have decreasing electrical conductivity values along the length of the counter electrode.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
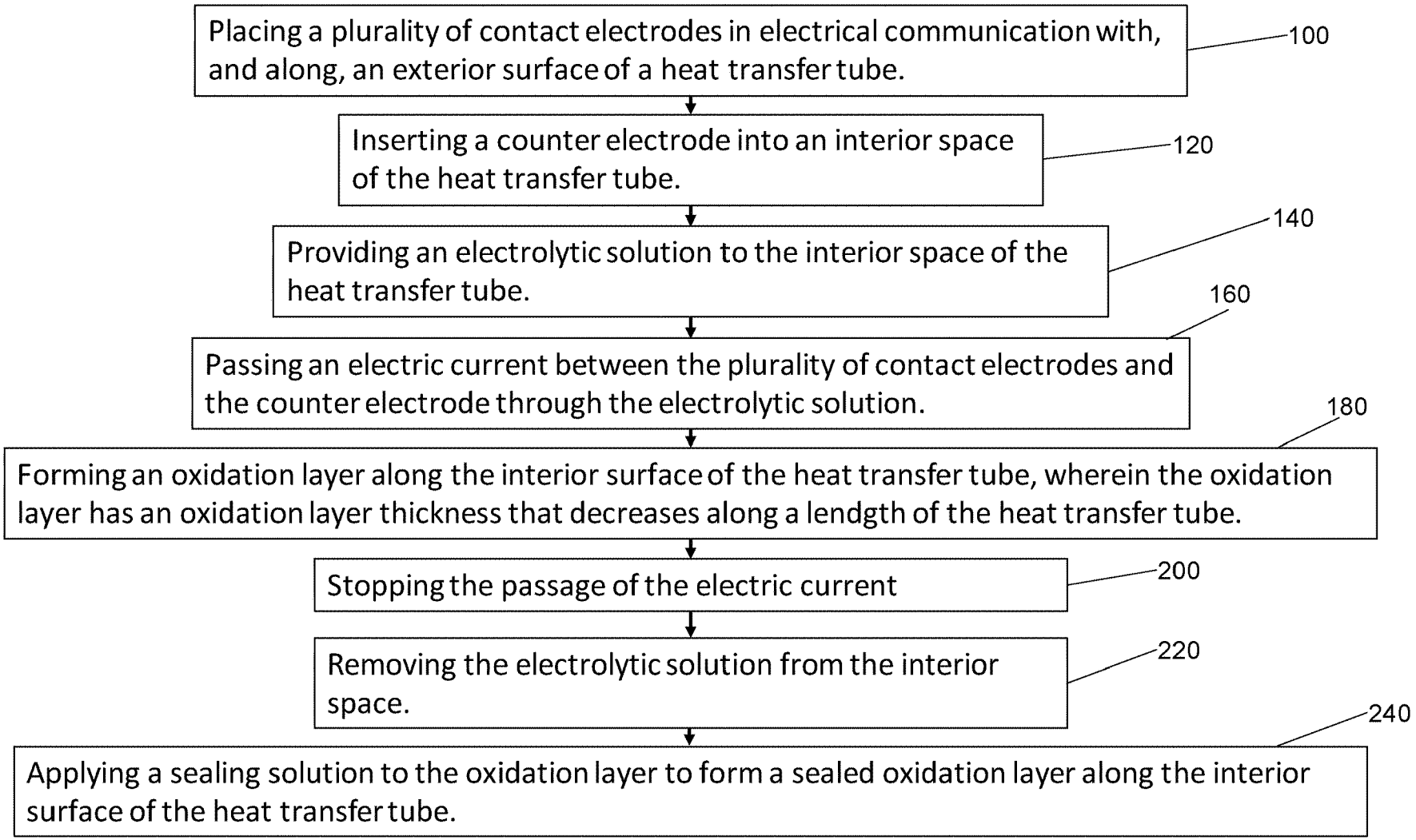
FIG. 1 is an illustration of the disclosed method steps.

A detailed description of one or more embodiments of the disclosed apparatus and method are presented herein by way of exemplification and not limitation with reference to the Figures.

A significant challenge to deploying aluminum parts in HVAC systems can be the susceptibility of aluminum to corrosion and fouling. In order to reduce the rate of corrosion, a surface treatment can be applied to protect the base aluminum or aluminum alloy material from corrosive interactions (e.g., with water and/or impurities therein, such as chlorine, fluorine, and other dissociated ionic species). However, a challenge with the surface treatment of heat exchanger tubes can be the presence of surface features on the surface of the tubes. Surface features can include fins, spikes, or other protrusions recessing into or extending from the internal and/or external surface or the tube. These features can be configured to break up boundary layer flow and increase the local convective heat transfer coefficient. When coatings are applied after the formation of surface features the coatings can partially defeat the benefit of the surface feature by filling the recesses, and/or covering the protrusions of the feature thereby limiting its effectiveness.

In solving these problems, the applicants have developed the disclosed method and apparatus for anodizing the interior surface of a heat transfer tube. As shown in the attached figures, the disclosed method includes a first step 100 of placing a plurality of contact electrodes (30*a*, 30*b*, 30*c*) in electrical communication with, and along, an exterior surface of a heat transfer tube 10. The contact electrodes (30*a*, 30*b*, 30*c*) can be wrapped around the exterior surface of the tube 10 and can be positioned with any desired spacing along the length of the tube 10. For example, contact electrodes (30*a*, 30*b*, 30*c*) can be equally spaced along the axial length of the tube 10, and can be wrapped substantially around the outside circumference of the tube 10. Placing the plurality of contact electrodes (30*a*, 30*b*, 30*c*) can include any suitable method of engaging the contact electrodes to the outer surface of the tube 10, such as sliding, wrapping, clipping, and/or sandwiching the counter electrodes over the tubes 10, and the like. Fasteners, belts or straps and tensioners, or other mechanical securements can be used to attach and/or press the contact electrodes ((30*a*, 30*b*, 30*c*) against the outer surface of the tube 10 to enhance electrical communication between the electrodes and the tube 10.

A second step 120 of the disclosed methods can include inserting a counter electrode 40 into an interior space 12 of the heat transfer tube 10. The counter electrode 40 can be positioned along a centerline 8 of the tube 10, or arranged about the centerline 8, such that there is substantially equal distance between a surface of the counter electrode 40 and an interior surface of the tube 10 in all radial directions. One or more positioning guides 59 can be located within the tube interior space 12 to aid in positioning the counter electrode 40 on or about the centerline 8 of the tube 10. Further, one or more centering holes 71 can be included in the positioning guide 59 to aid in positioning the counter electrode along or about the centerline 8. The positioning guide 59 can include surrounding holes 72 which can allow fluid to flow through the tube 10 during the disclosed methods. The positioning guides 59 can be made of a dielectric material that is not electrically conductive, such that contact with the counter electrode 40 and the tube 10 will not short the electrolytic circuit created during anodizing.

Figure 2:
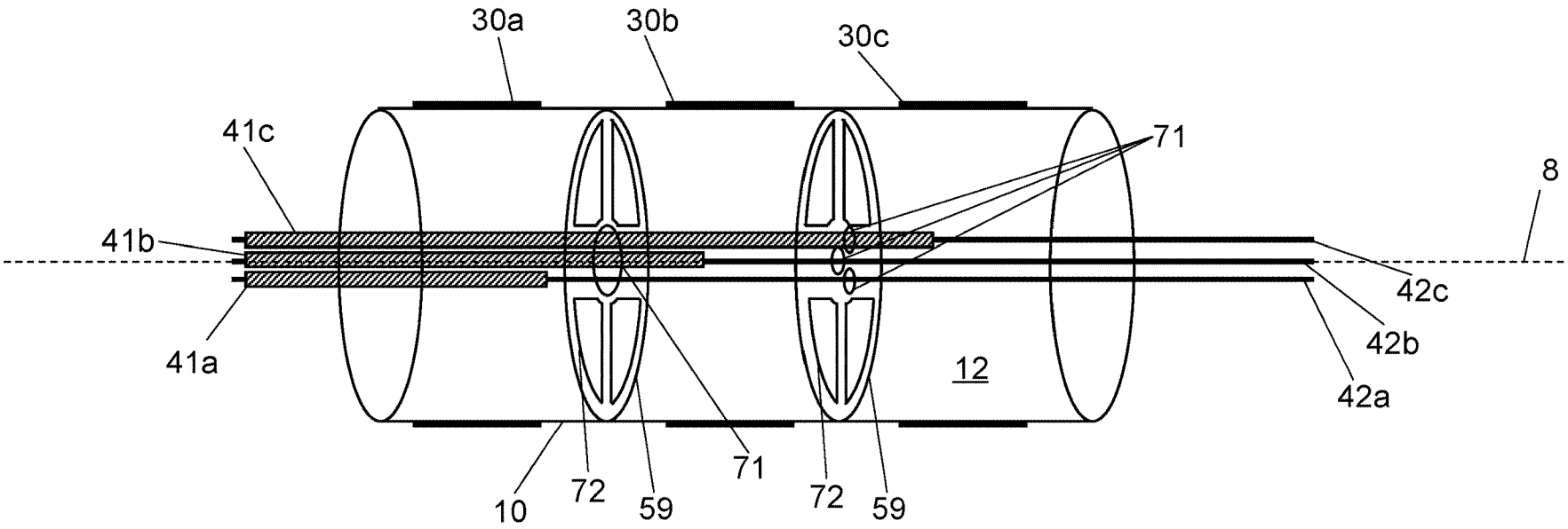
FIG. 2 is a schematic illustration of a heat transfer tube and a counter electrode having multiple metal elements.
Figure 3:
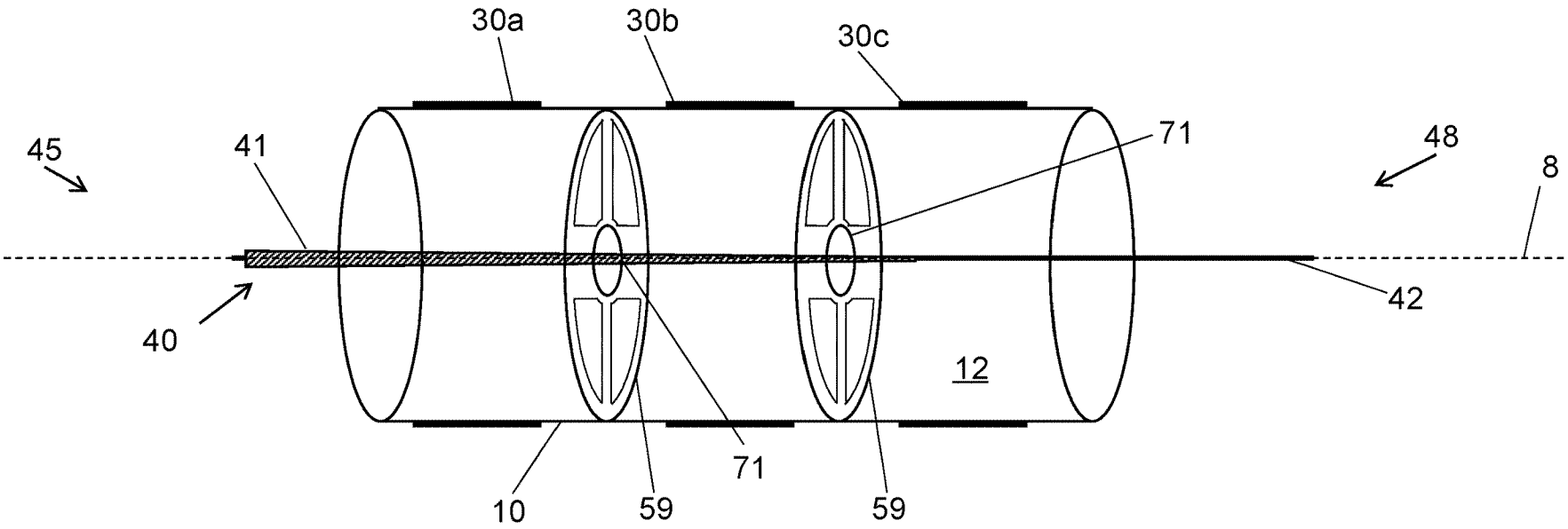
FIG. 3 is a schematic illustration of a heat transfer tube and a counter electrode having a decreasing thickness shielding material thereon.

The counter electrode 40 can include a single metal element or a plurality of metal elements (42*a*, 42*b*, 42*c*) arranged together to form the counter electrode 40, e.g., as shown in FIG. 2. The counter electrode 40 can include a metal that is more noble than aluminum, e.g., ruthenium, rhodium, palladium, silver, osmium, iridium, platinum, gold, copper, mercury, and rhenium. The one or more metal elements can include electrical shielding material (41*a*, 41*b*, 41*c*) disposed along at least a portion of its length. The electrical shielding material (41*a*, 41*b*, 41*c*) can include a dielectric material, e.g., thermoplastics such as polypropylene, polytetrafluoroethylene (PTFE), polyethylene (such as high density polyethylene, HDPE), and the like, configured to prevent the flow of electrical current through the counter electrode 42 along portions covered by the electrical shielding material 41. Thermoplastics can be chosen based on their compatibility with the electrolyte solution 61 (e.g., chemicals that are inert or non-reactive when exposed to the electrolyte solution 61, electrodes, components, and work pieces such as heat exchanger tubes), such as described by American Society for Testing and Materials (ASTM) D543-20 in force at the time of filing the present application. An effective thickness of the electrical shielding material 41 can vary along the length of the counter electrode 40. For example, the electrical shielding material 41 can be thickest at one end 45 of the counter electrode and can transition to a smaller thickness material, or to a bare, exposed, metal element at an opposite end 48. The transition in thickness of the electrical shielding can be continuous or discontinuous, including a sloped transition, a stepped, and the like. For example, the counter electrode 40 can include a plurality of metal elements (42*a*, 42*b*, 42*c*) each having electrical shielding material (41*a*, 41*b*, 41*c*) covering one or more sections of the length of the metal elements (42*a*, 42*b*, 42*c*) to form a stepped transition in effective electrical shielding thickness. Thus, creating a stepped transition in radial current flow through an electrolytic solution 61 between the counter electrode 40 and the tube 10 which changes as a function of the tube length. In another example, e.g., as shown in FIG. 3, the counter electrode 40 can include a single metal element 42 having an electrical shielding material 41 configured in a decreasing thickness along the length of the counter electrode 40. Thus, creating a continuous transition in radial current flow through an electrolytic solution 61 between the counter electrode 40 and the tube 10 which changes as a function of the tube length.

Shielding current flow through the electrolytic solution can allow for anodizing to different depths along the interior surface of the heat transfer tube 10. For example, allowing for changes in oxidation depth as a function of the length of the heat transfer tube 10. Such methods can be used to provide additional protection to areas of the heat transfer tube 10 that are most susceptible to corrosion, such as at the hottest axial positions of the tube when used in a heat exchanger (e.g., sections of the tube that will be nearest to a hot inlet fluid stream, or hot side inlet manifold).

Variable coating thickness can be achieved through the use of a counter electrode 40 which extends partially into the heat transfer tube 10, e.g., less than the full length of heat transfer tube 10. Such methods can allow for localization and/or thickening of the surface treatment along portions of the interior surface of the heat transfer tube 10 where the counter electrode 40 is present (e.g., while little or no surface treatment will form along portions where the counter electrode is not present). For example, a counter electrode 40 can be inserted partially into a heat transfer tube 10 to form a surface treatment along the tube interior surface for a distance that corresponds to the depth of the insertion. In this way, the surface treatment can be thickest at one end of the heat transfer tube 10 and thinnest, or non-existent, at the opposite end.

Furthermore, electrical shielding material 41 can include one or more conductive sections and one or more partially non-conductive sections. The one or more conductive sections and one or more partially non-conductive sections can be arranged in any pattern along the length of the counter electrode 40. The sections can include a dielectric material (e.g., thermoplastics such as polyvinyl chloride, polyethylene, and the like) the composition and/or thickness of which can be tailored to allow a desired current flux distribution (or current density distribution, e.g., distribution of current flow along the inner surface of the heat transfer tube 10), or lack thereof, for each section. In these ways, the electrical conductivity profile along the length of the counter electrode 40 can be tailored to account for changes in corrosive and/or fouling conditions that may be present along the length of the heat transfer tube 10 when in operation.

A third step 140 of the disclosed methods can include providing an electrolytic solution 61 to the interior space 12 of the heat transfer tube 10. An electrolytic solution 61 can include an acid (e.g., sulfuric acid, chromic acid, phosphoric acid, and the like) which can be provided to the interior space 12 of the heat transfer tube 10 using any suitable means. For example, as in FIG. 4 the electrolytic solution 61 can be pumped through the tube 10 in a flow process, or as in FIG. 5, the tube 10 can be placed into a bath of electrolytic solution 61 in a batch process. The electrolytic solution can include an oxygen rich electrolyte. The electrolytic solution 61 can include dye, pigment, etching solution, or other chemicals which can be used to influence the physical characteristics of the oxide layer such as porosity, adherence to tube surface, and color.

Figure 4:
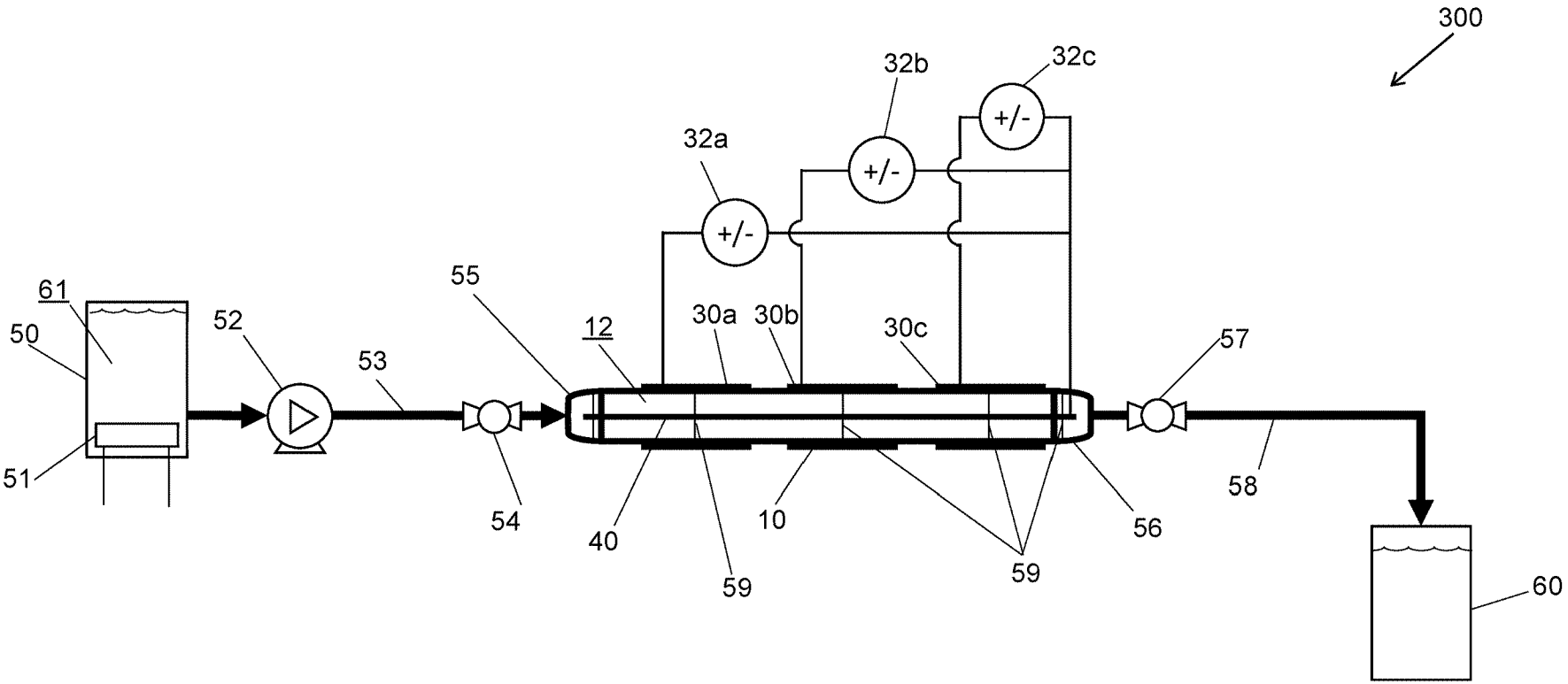
FIG. 4 is a schematic illustration of a heat transfer tube in a heat transfer tube anodizing apparatus having a flow process.

Referring to FIG. 4, a heat transfer tube anodizing apparatus 300 can include a pump 52 which can pump the electrolytic solution 61 from a source reservoir 50 through the heat transfer tube 10 to an accumulator 60. The source reservoir 50 can include a heat exchanger 51 for heating or cooling the electrolytic solution 61 to a desired processing temperature. An inlet valve 54 and outlet valve 57 can be used to isolate the inlet flow line 53 and outlet flow line 58 from the heat transfer tube 10 while the tube is configured for processing. An inlet end cap 55 and an outlet end cap 56 can be used to fluidly connect the heat transfer tube 10 to the inlet flow line 53 and the outlet flow line 58 respectively. If the concentration of active species (e.g., sulfuric acid, chromic acid, phosphoric acid, and the like) in the electrolytic solution 61 at the accumulator 60 is sufficiently high then the solution can be optionally recycled back to the source reservoir 50 where it can be reused in the process.

Figure 5:
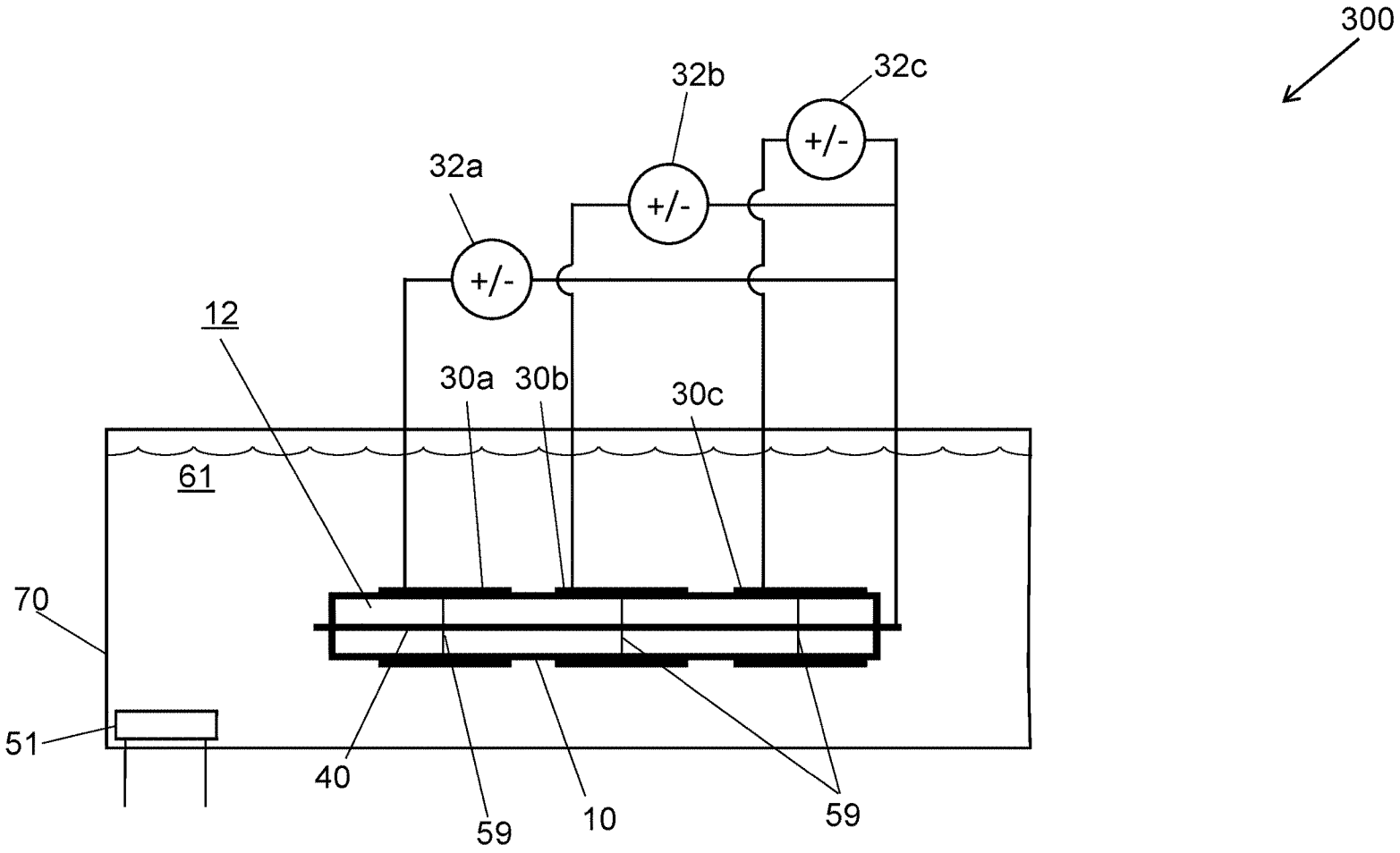
FIG. 5 is a schematic illustration of a heat transfer tube in a heat transfer tube anodizing apparatus having a batch process.

Referring to FIG. 5, a heat transfer tube anodizing apparatus 300 can be configured for the heat transfer tube 10, provided with the counter electrode 40, to be submerged into a tub 70 containing a volume of electrolytic solution 61 disposed therein. The interior surfaces of the tub 70 can be made of, or protectively coated with, a high dielectric, corrosion resistant material suitable for containing the electrolytic solution 61 such as plastic (e.g., polyethylene, polytetrafluoroethylene). If desired, a heat exchanger 51 can be used to heat or cool the electrolytic solution 61 within the tub 70 to a desired processing temperature.

A fourth step 160 of the disclosed methods can include passing an electric current between the plurality of contact electrodes (30*a*, 30*b*, 30*c*) and the counter electrode 40 through the electrolytic solution 61. One or more power supplies (32*a*, 32*b*, 32*c*) can be configured in electrical communication with the one or more contact electrodes (32*a*, 32*b*, 32*c*) and one or more metal elements of the counter electrode 40. The one or more power supplies (32*a*, 32*b*, 32*c*) can be used to create an electrical potential difference between the tube 10 and the counter electrode 40. The one or more power supplies (32*a*, 32*b*, 32*c*) can be in control communication with a controller configured to adjust an electrical parameter of the one or more power supplies (32*a*, 32*b*, 32*c*) to maintain a desired output voltage of the power supply (e.g., electrical potential difference across the electrodes), a desired output current flow from the power supply through the electrolytic solution 61, a desired power output from the power supply, or a combination including at least one of the foregoing. This electrical potential difference creates a driving force for current to flow from the counter electrode 40 through the electrolytic solution 61 and to the inner surface of the tube 10. The inner surface of the tube 10 can act as the anode where oxygen gas is released and an aluminum oxide layer forms and grows while the counter electrode 40 can act as the cathode where hydrogen gas is liberated.

A fifth step 180 of the disclosed process can include forming an oxidation layer along the interior surface of the heat transfer tube 10. The oxidation layer can form when the electrolytic solution 61 is present between the counter electrode 40 and the contact electrodes (32*a*, 32*b*, 32*c*) and a difference in electrical potential is created therebetween. The electrical potential difference, the concentration, the acidity, and the temperature of the electrolytic solution 61, the current flow, or a combination including at least one of the foregoing can be controlled in order to provide the tube 10 with the desired oxidation layer. Further, the profile of the oxidation layer can be tuned to provide the desired corrosion resistance as a function of the length of the tube 10, which can allow for optimizing the oxidation layer based on material properties such as heat transfer resistance effect (e.g., thermal conductivity) and corrosion resistance effect. For example, the oxidation layer can be thicker along a portion of the length of the heat transfer tube 10 that has an increased electrical potential applied thereto. The increased electrical potential applied to a section of the tube 10 can be the result of a higher electrical potential applied to the section or can be due to a reduction in the effective thickness of the electrical shielding material 41 layer(s) of the counter electrode 40 along that section, or a compositional change in the electrical shielding material 41 (e.g., resulting in lower shielding strength). The oxidation layer can have an oxidation layer thickness that decreases along a length of the heat transfer tube 10, e.g. having decreasing thickness from one end 45 to an opposite end 48. The oxidation layer developed as described herein can have a maximum thickness at a point along the length of the heat transfer tube 10 of less than or equal to about 10 micrometers (μm), or from about 1 μm to about 8 μm, or from about 1 μm to about 7 μm, or from about 1 μm to about 6 μm, or from about 2 μm to about 8 μm, or from about 2 μm to about 7 μm, or from about 2 μm to about 6 μm, or from about 3 μm to about 8 μm, or from about 3 μm to about 7 μm, or from about 3 μm to about 6 μm, or less than or equal to about 5 μm, or less than or equal to about 4 μm, or less than or equal to about 3 μm, or less than or equal to about 2 μm, or less than or equal to about 1 μm. In an example, an electrical potential difference of from about 12 volts direct current (VDC) to about 18 VDC can be applied between the contact electrodes (30*a*, 30*b*, 30*c*) in electrical communication with a heat transfer tube including substantially 6000 series aluminum and the counter electrode 40 for a duration of from about 15 to about 30 minutes to form an oxidation layer having a maximum thickness of from about 3 μm to about 6 μm along the interior surface of the heat transfer tube 10.

A sixth step 200 of the disclosed process includes stopping the passage of the electric current. Once the desired oxidation layer thickness is reached the applied electrical potential can be removed and current flow through the electrolyte solution 61 can be stopped.

A seventh step 220 of the disclosed process can include removing the electrolytic solution 61. Removing can include separating the electrolytic solution 61 from the interior space 12 of the heat transfer tube 10 in any suitable way. For example, as in FIG. 4, the flow electrolytic solution 61 can be stopped and a washing fluid (e.g., water), a sealing solution, or the like, can be used to flush the interior space 12 of the heat transfer tube 10. In another example, as in FIG. 5, the heat transfer tube 10 can be removed from the bath of the electrolytic solution 61 and placing in a separate washing tub containing a washing fluid (e.g., water).

An eighth step of the disclosed process can include applying a sealing solution (e.g., a corrosion resistive solution) to the oxidation layer that is formed on the interior surface of the heat transfer tube 10. The sealing solution can help reduce the rate at which the oxidation layer is corroded thereby helping to improve durability. Examples of sealing solution can include, but is not limited to, an aqueous solutions of nickel acetate, potassium hexafluorozirconate and trivalent chromium sulfate (e.g., Trivalent Chrome Process (TCP)) and deionized water. Further, an aqueous nickel acetate sealing step can include exposing the interior surface of the heat transfer tube 10 to aqueous solution of from about 0.5 weight % (wt %) to about 3 wt % nickel acetate, at a temperature of from about 190° F. to about 210° F., for a duration of from about 15 minutes to about 30 minutes. Further, a TCP sealing step can include exposing the interior surface of the heat transfer tube 10 to from about 10 wt % to about 30 wt % trivalent chromium sulfate, at about ambient temperature (e.g. 72° F.), for a duration of from about 5 minutes to about 15 minutes. Further, a deionized water sealing step can include exposing the interior surface of the heat transfer tube 10 to deionized water, at a temperature of boiling (e.g., 212° F. at 1 atmosphere of pressure), for a duration of from about 30 minutes to about 45 minutes.

The heat transfer tube 10 having an oxidation layer formed therein, as described herein, can be used in the manufacture of a heat exchanger. For example, the heat transfer tube 10 can be used in the manufacture of a shell and tube heat exchanger, finned tube heat exchanger, plate-fin tube heat exchange, and the like. The heat exchanger can be used in the construction of heating, air conditioning, and refrigeration equipment. For example, the heat transfer tube 10 can be used in the construction of a shell and tube heat exchanger that can be configured for use in a chiller of an air conditioning system. The oxidation layer formed as described herein can provide the heat transfer tube 10 with additional protection from corrosion and fouling over its lifetime of operation while minimizing impact of oxidation layer thickness on the thermal conductivity of the heat transfer tube 10.

The numerical steps described herein are not intended to designate a corresponding temporal sequence or order of operations. Unless indicated otherwise, the steps can be performed in any order, separated into distinct temporal events, combined into a single temporal event, or can overlap temporally, without departing from the nature of, and still benefiting from, the present disclosure.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A heat transfer tube anodizing apparatus comprising:

a plurality of contact electrodes configured for placement in electrical communication with, and along, the external surface a heat transfer tube, a counter electrode comprising a decreasing thickness of an electrical shielding along at least a portion of its length, a power supply comprising a positive terminal and a negative terminal, wherein the plurality of contact electrodes are disposed in electrical communication with the positive terminal and the counter electrode is disposed in electrical communication with the negative terminal, and a controller configured to adjust an electrical parameter of the power supply, wherein the electrical parameter comprises an output power, and output voltage, an output current, or a combination comprising at least one of the foregoing.

2. The heat transfer tube anodizing apparatus of claim 1, wherein the counter electrode comprises a metal wire having the electrical shielding extending along at least a portion of its length.

3. The heat transfer tube anodizing apparatus of claim 1, wherein the counter electrode comprises a plurality of metal wires having the electrical shielding extending along at least a portion of their lengths.

4. The heat transfer tube anodizing apparatus of claim 1, wherein the electrical shielding comprises a plurality of electrical shielding sections disposed along the length of the counter electrode, and wherein at least two sections have different electrical conductivity values.

5. The heat transfer tube anodizing apparatus of claim 4, wherein the plurality of electrical shielding sections are arranged to have decreasing electrical conductivity values along the length of the counter electrode.

* * * * *